United States Patent [19]

Russell, III

[11] 4,395,059

[45] Jul. 26, 1983

[54] FOLDABLE POSTING BOARD ASSEMBLY

[76] Inventor: Thomas H. Russell, III, 14 Sulgrave Rd., West Hartford, Conn. 06107

[21] Appl. No.: 208,306

[22] Filed: Nov. 19, 1980

[51] Int. Cl.[3] ..... B42F 13/00

[52] U.S. Cl. ..... 282/29 B; 402/79

[58] Field of Search ..... 282/29 R, 29 A, 29 B, 282/22 A, 23 A, 24 B, 29 C; 281/26, 19 A, 25 A; 402/8, 79, 19, 20, 21, 22, 31, 40, 57; 283/66 R, 66 A, 63 R, 63 A

[56] References Cited

U.S. PATENT DOCUMENTS

| | | | |
|---|---|---|---|
| 1,107,351 | 8/1914 | Proudfit | 402/79 |
| 1,778,766 | 10/1930 | McMichael | 282/29 R |
| 2,116,589 | 5/1938 | Trussell | 281/25 A |
| 2,153,575 | 4/1939 | Kramer | 402/19 |
| 2,210,022 | 8/1940 | Bunto | 402/19 |
| 2,583,998 | 1/1952 | Cook | 281/19 A |
| 2,747,895 | 5/1956 | Hall | 282/29 B |
| 2,764,162 | 9/1956 | Valla | 402/21 |
| 3,184,255 | 5/1965 | Rohde | 282/29 B |
| 3,236,542 | 2/1966 | Russell | 282/29 B |
| 3,315,683 | 4/1967 | Rodriguez et al. | 402/79 |
| 3,498,640 | 3/1970 | Russell | 282/29 B |
| 3,719,161 | 3/1973 | Wegner | 402/79 |
| 3,970,397 | 7/1976 | Armstrong | 402/79 |
| 4,029,342 | 6/1977 | Goodman | 282/29 B |
| 4,141,009 | 2/1979 | Negro et al. | 281/25 A X |

*Primary Examiner*—Paul A. Bell
*Assistant Examiner*—John S. Brown
*Attorney, Agent, or Firm*—McCormick, Paulding & Huber

[57] ABSTRACT

A foldable posting board has a plurality of hingedly connected panels. Resilient wire loop bindings connected to the panels extend along side edges of the panels and define vertical columns of mounting posts which project through and cooperate with apertures in a record sheet to retain the sheet in a predetermined position relative to the panels. Apertured forms received on the posts are retained in overlying registry with the record sheet. One of the bindings forms a hinge for the panels.

27 Claims, 12 Drawing Figures

FOLDABLE POSTING BOARD ASSEMBLY

BACKGROUND OF THE INVENTION

This invention relates in general to bookkeeping apparatus and deals more particularly with an improved posting board assembly of the type wherein the drafting of a check, receipt, or similar form causes the information entered on the form to be simultaneously recorded in proper position on an associated underlying record sheet such as a journal sheet and, where desired, also simultaneously posted to a number of various ledger cards such as subsidiary accounts receivable, accounts payable, individual payroll record cards, general ledger cards, distribution cards, such as job cost cards, and the like.

Early posting boards were usually relatively large, rigid panel structures with one or more rows of fixed pegs or mounting posts for holding forms in registration, and were cumbersome to use and store. Difficulties were encountered in producing uniform record sheets with punched holes accurately spaced to receive the spaced apart rows of fixed pegs so that each record sheet would be held in a predetermined position and lie flat regardless of minor punching inaccuracies. The tendency for paper to expand and contract with changes in temperature and humidity further compound this problem.

In my U.S. Pat. No. 3,498,640 for BOOKKEEPING APPARATUS, issued Mar. 3, 1970, there is illustrated and described an arrangement for mounting a pegrail between two rigid pieces of material with the pegs or posts thereof protruding through holes in one of the pieces, the holes being somewhat larger than the cross-sectional dimensions of the pegs so that the pegs may move in unison within narrow limits to accommodate minor variations in the spacing between columns of punch holes in a journal or record sheet. While such posting board apparatus adequately compensates for variations in record sheets, the arrangement for supporting the movable pegrail makes the apparatus relatively costly to produce. In a bookkeeping system where a relatively large number of separate posting boards are maintained, as in keeping payment records for a relatively large number of bank accounts or several different companies, the initial investment required to establish the system may be quite substantial. Further, the arrangement for mounting the pegrails is not readily adaptable to folding posting boards. Accordingly, it is the general aim of the present invention to provide an improved compact, lightweight posting board assembly which may be of a foldable type and which, if desired, may be flexible. It is a further aim of the invention to provide an improved posting board assembly which compensates for variations in the physical dimensions of record sheets, may be utilized to hold a variety of ledger cards or other forms in accurate registration with a larger number of different record sheet surfaces for efficient utilization of available record sheet entry space and without tendency to slip out of registration before any entry is completed, and which may be manufactured and marketed at relatively low cost.

SUMMARY OF THE INVENTION

A posting board assembly comprises a foldable posting board and at least one record sheet. The posting board includes a generally rectangular panel having a vertical column of openings therethrough which extend along one side marginal portion thereof. A binding formed from a length of resilient wire has a vertical column of loops. Each of the loops extends through an associated one of the openings in the panel and defines a column of mounting posts which project beyond the surfaces of the panel. The one record sheet has a vertical column of apertures through it. Each mounting post projects through an associated one of the apertures. The posts cooperate with the apertures to releasably retain the one record sheet in assembled relation with the posting board and in a predetermined posting position relative to the panels.

DETAILED DESCRIPTION OF PREFERRED EMBODIMENT

Figure 1:
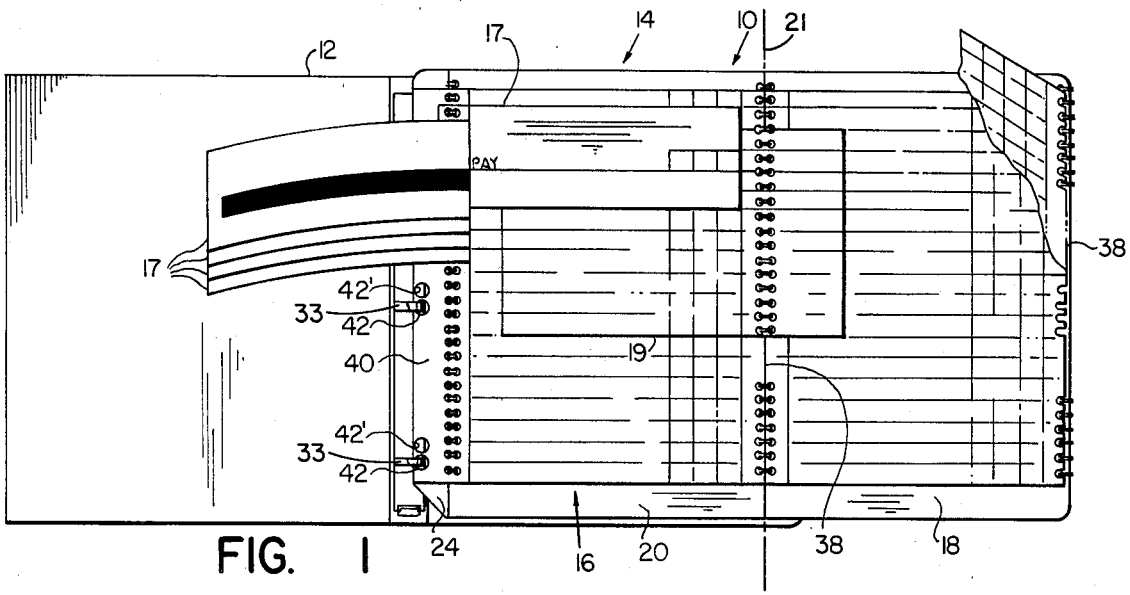
FIG. 1 is a plan view of a foldable posting board assembly embodying the present invention and shown connected to a loose leaf ring binder.
Figure 2:
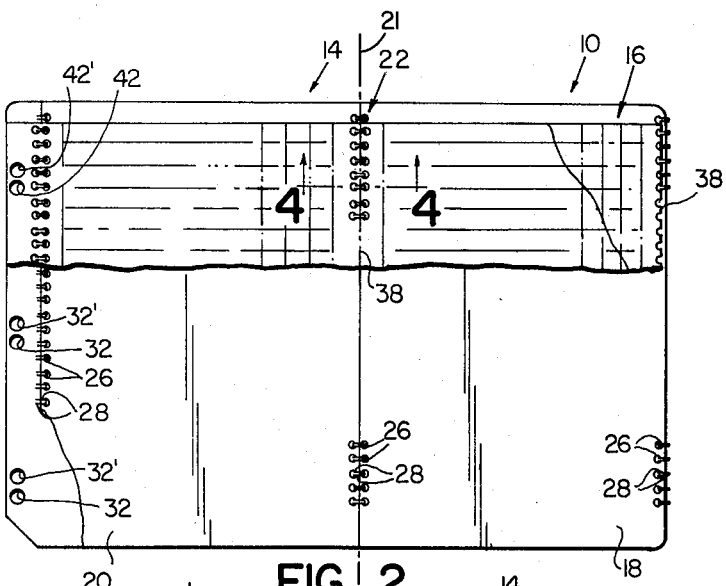
FIG. 2 is a plan view of the foldable posting board assembly of FIG 1 shown in an open position.
Figure 4:
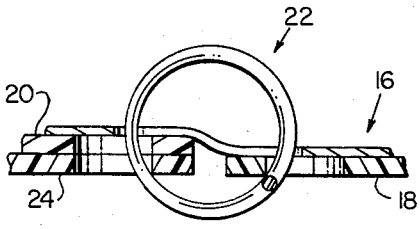
FIG. 4 is a somewhat enlarged fragmentary sectional view taken along the line 4—4 of FIG. 2.

Turning now to the drawings, and referring first particularly to FIGS. 1 and 2, a foldable posting board assembly embodying the present invention is indicated generally by the reference numeral 10. The posting board assembly 10 is preferably generally rectangular and has the size and shape of a conventional file folder so that it may be conveniently stored in a file drawer. In FIG. 1 the posting board assembly 10 is shown connected to a conventional foldable loose leaf ring binder 12 within which it may be conveniently stored together with additional record sheets and/or forms for use with the posting board.

The posting board assembly 10 essentially comprises a posting board, designated generally by the numeral 14, and at least one record sheet, such as the record sheet indicated generally at 16, which is releasably secured to the posting board 14. The posting board is adapted to releasably retain one or more forms, such as checks indicated at 17, 17, and a ledger card 19 in overlying registry with the record sheet 16, all of which will be hereinafter more fully discussed.

Considering the posting board assembly 14 in further detail, it essentially comprises at least two generally rectangular panels 18 and 20 and a wire loop binding, indicated generally at 22, which hingedly connects the panels 18 and 20 to fold about a hinge line 21. The binding 22 also defines a vertical column of mounting posts or pegs which project bodily through apertures in the record sheet 16 releasably retain the record sheet 16 in a predetermined position relative to the panels, as will be hereinafter further described. The illustrated posting board 14 has a third panel 24 hingedly connected to the panels 18 and 20 by the binding 22 located along a line generally coincident with the hinge line 21. Each of the panels 18, 20 and 24 has at least one vertical column of openings or holes 26, 26, which are preferably circular and open through and extend along at least one side marginal portion to receive the binding 22.

Figure 5:
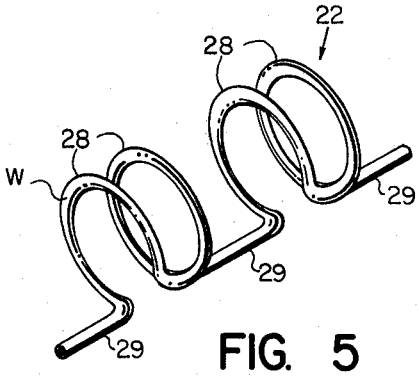
FIG. 5 is a somewhat enlarged fragmentary perspective view of a typical wire loop binding.

The illustrated wire loop binding 22, best shown in FIG. 5, is of a well-known type marketed by Wire-O-Corp., Division of Standex Company, Poughkeepsie, N.Y. and comprises a length of wire W which forms a series of interrupted generally circular loops, 28, 28. Preferably, and as shown, the loops 28, 28 are arranged in sets integrally joined by connecting portions 29, 29 which extend in a generally axial direction. Each set of loops includes at least two loops which extend through an associated one of the openings 26, 26 in each of the panels 18, 20 and 24. The loops 28, 28 which comprise the binding 22 are disposed generally within parallel planes generally normal to the planes of the panels. Each circular hole 26 has a diameter substantially greater than the axial width dimension of an associated set of loops. Thus, the binding 22 is supported by sets of loops 28, 28, defines binding rings received within associated holes 26, 26, and is arranged for limited movement in both horizontal and vertical directions relative to the panels 18, 20 and 24, for a purpose which will be hereinafter evident.

Figure 3:
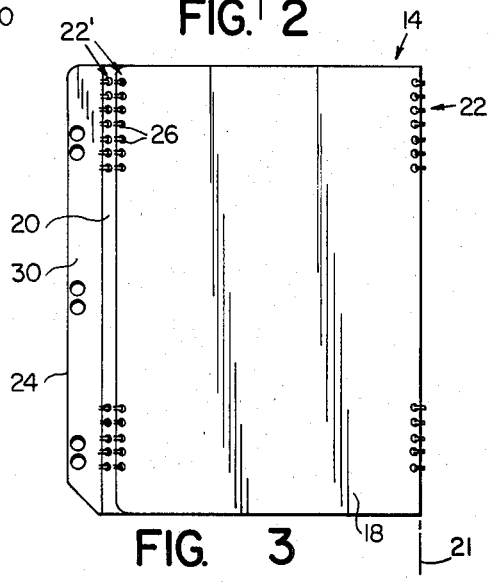
FIG. 3 is a plan view of the posting board assembly shown in closed position.

Preferably, and as shown, the panels 18, 20 and 24 are of differing horizontal widths. Each of the panels 18 and 20 has an additional column of circular holes 26', 26' along its other or free side marginal portion and another wire loop binder 22' which is connected to it by a set of loops 28', 28' engaged within the holes 26', 26'. The panels 18 and 20 are foldable relative to the binding 22 between an open position shown in FIG. 2 and a closed position shown in FIG. 3. In closed position the panels are disposed in generally overlying relation to each other, the panel 20 being disposed generally between panels 18 and 24, as best shown in FIG. 3. In the closed position the free edge portion of the panel 20, that is the side edge remote from the binding or connecting hinge 22 is spaced laterally outwardly beyond the associated free side edge of the panel 18, so that the bindings 22', 22' are not in interfering relation with each other enabling the posting board to be folded to substantially flat position. In the closed position the free side portion of the panel 24 is disposed laterally outwardly beyond the free side edge of the panel 20 to define a marginal heading, indicated by the numeral 30, which may be labeled to identify a specific account, for example, when the posting board is to be stored in a manner of a file folder. In the illustrated embodiment 10, holes 32, 32 are formed in the marginal portion to receive the retaining rings 33, 33 of the loose leaf binder 12, as shown in FIG. 1. Additional holes 32', 32' in the marginal portion 30 allow the posting board 14 to be secured in the loose leaf binder 12 in another position vertically upwardly offset from the position shown in FIG. 1, and for a purpose which will be hereinafter described.

Figure 7:
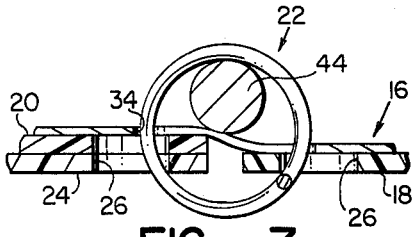
FIG. 7 is a fragmentary sectional view taken along the line 7—7 of FIG. 6.
Figure 8:
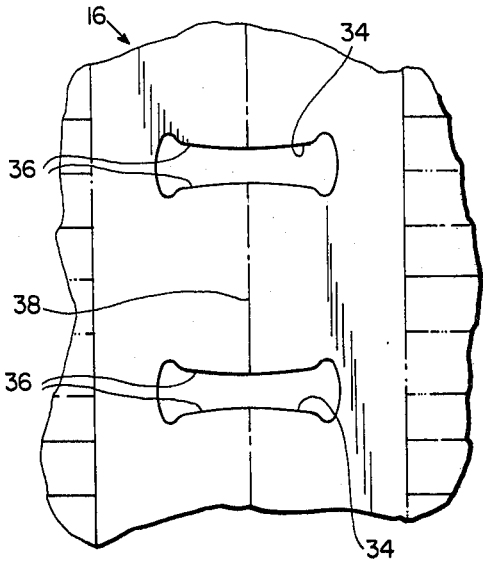
FIG. 8 is a fragmentary plan view of a record sheet.

The arrangement of printed material on the record sheet and the manner in which the record sheet is attached to the posting board may vary. The illustrated record sheet 16 has lines imprinted on its front and rear surfaces which divide the sheet into a multiplicity of entry spaces arranged in rows and columns on the sheet. Three columns of apertures or slots 34, 34 are punched in the sheet for receiving the sets of binding loops associated with the bindings 20, 22' and 22'. Each slot 34 is partially defined by at least one tab 36 adapted to be received within an associated loop 28 when the record sheet is attached to the posting board 14. Preferably, and as shown, each slot 34 is generally bone shaped and partially defined by a pair of opposing tabs 36, 36, as shown in FIG. 7. When the record sheet is assembled with the posting board 14 in its open or unfolded condition each aperture 34 entirely surrounds a respectively associated set of loops 28, 28. The tabs 36, 36 cooperate with the mounting posts, collectively defined by sets of loops 28, 28, to releasably retain the record sheet in a predetermined position relative to the various panels which comprise the posting board 14.

Two vertically extending fold lines 38, 38 divide the record sheet 16 into three sections. Each fold line 38 bisects the slots 34, 34 in an associated column. The illustrated record sheet 16 also has a heading space 40 along one side marginal portion of the sheet and which overlies the heading space 30 on the panel 24, as best shown in FIG. 2. Information recorded on the heading sheet 40 is visible when the posting board is in its closed position. A first group of holes 42, 42 punched through the heading space 40 facilitate attachment of the record sheet in a first position to the ring binder 12, shown in FIG. 1. A second group of holes 42', 42' punched through the heading space 40 enable the record sheet to be connected to the ring binder 12 in a second position vertically downwardly offset from the first position. Thus, when the posting board 14 is connected to the ring binder 12 in an upwardly offset position, using the mounting holes 32', 32' and the record sheet 16 is attached to the ring binder in its second or downwardly offset position utilizing the mounting holes 42', 42' the upper edge of the posting board 14 is disposed a substantial distance above the upper edge of the record sheets. This arrangement permits attachment of a master heading sheet to the ring binder between the posting board 14 and the record sheet 16 so that headings imprinted on the master heading sheet are exposed immediately above the upper edge of the record sheet and in vertical alignment with columns of entry spaces on the record sheet.

The second sheet 16 is used in conjunction with other forms such as checks, receipts or the like and in FIG. 1 there is shown a plurality of checks 17, 17 and a ledger card 19 secured to the posting board to overlie an associated portion of the record sheet 16. The checks are arranged in fanned relationship with their edges aligned and with the upper edge of each check protruding upwardly a predetermined distance beyond the upper edge of the adjacent overlying check. As shown in FIG. 1, all of the checks except the lowermost check may be folded to the left to completely expose the lowermost check and permit drafting of the check and the entry of other information thereon. Each check 17 is provided with a row of spaces which are in registry with entry spaces on the ledger card 19 and on the record sheet 16. A carbon strip 43 or other transfer means on the back surface of the check in registry with the row of spaces on the front surface of the ledger card 19 and a carbonless coating (not shown) on the back surface of the ledger card enables simultaneous transfer of the information entered on the check to associated spaces on the ledger card and the record sheet, in a manner well-known in the art.

A further disclosure of various combinations of record sheets and forms and the manner in which these record sheets and forms may be attached to a posting board assembly is shown and described in my U.S. Pat. Nos. 3,236,542 for BOOKKEEPING APPARATUS, issued Feb. 22, 1966 and 3,498,640 for BOOKKEEPING APPARATUS, issued Mar. 3, 1970 which are hereby adopted by reference as part of the present disclosure.

As previously noted, when the record sheet 16 is attached to the posting board 14 the tabs 36, 36 cooperate with respectively associated sets of binding loops to releasably retain the record sheet in assembly with the posting board. However, if desired, other means may be provided for releasably retaining the record sheets and forms in assembly with the posting board 14 and may be used with the tabs or in place of them.

Figure 6:
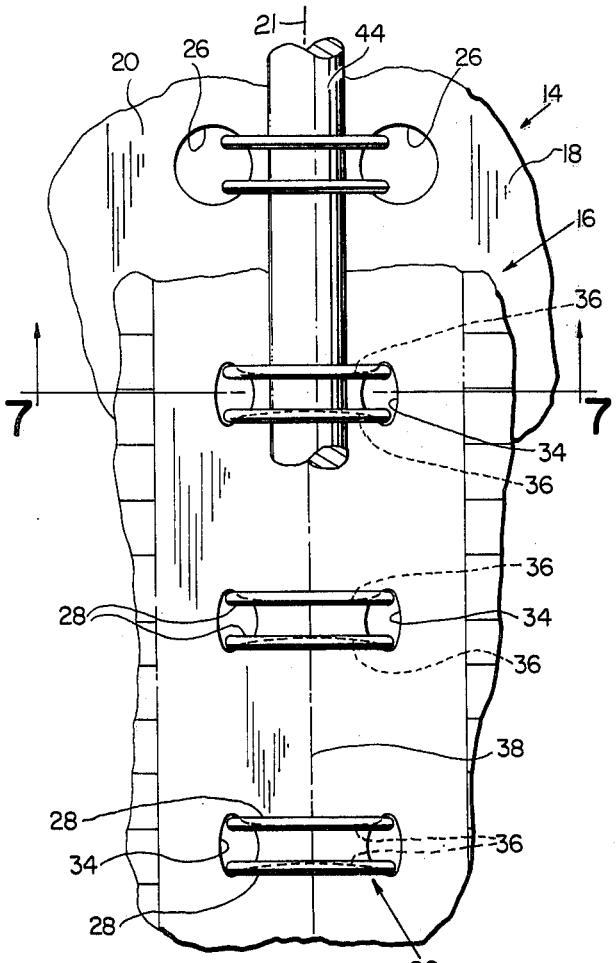
FIG. 6 is a somewhat enlarged fragmentary plan view of the posting board assembly, as it appears in FIG. 2.
Figure 9:
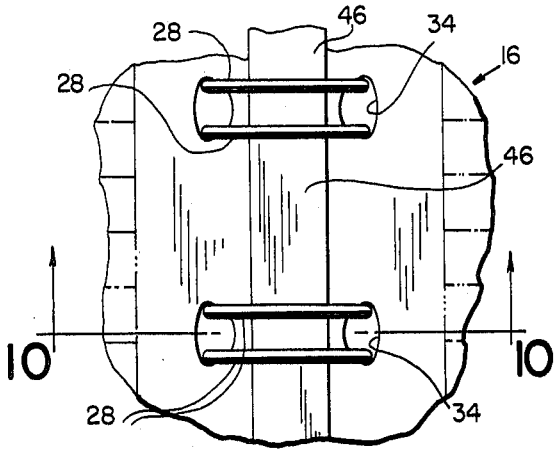
FIG. 9 is similar to FIG. 6, but shows another embodiment of the invention.
Figure 10:
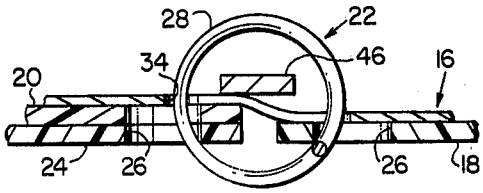
FIG. 10 is a fragmentary sectional view taken along the line 10—10 of FIG. 9.
Figure 11:
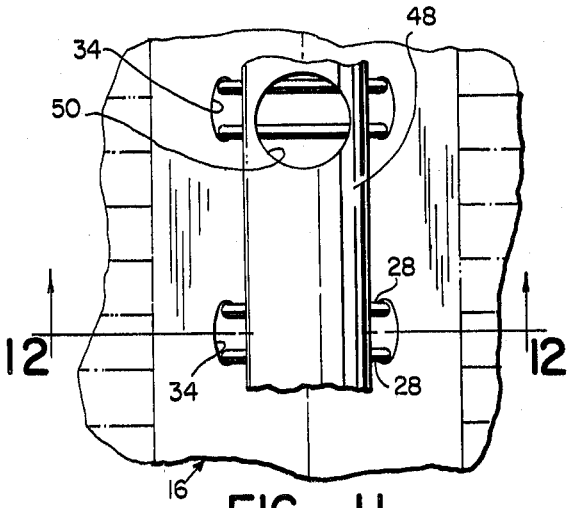
FIG. 11 is also similar to FIG. 6, but shows still another embodiment of the invention.
Figure 12:
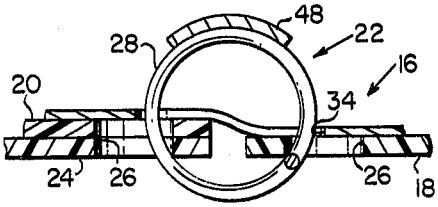
FIG. 12 is a fragmentary sectional view taken along the line 12—12 of FIG. 11.

In FIGS. 6 and 7 there is shown an elongated rod 44 which extends in an axially vertical direction through the loops which comprise the binding 20 to releasably retain the record sheet 16 in assembly with the posting board 14. A further embodiment of the invention is shown in FIGS. 9 and 10 wherein an elongated flexible thong, which may be made from plastic, for example, is inserted through the loops of the binding 20 to releasably retain the record sheet in assembly with the posting board. The thong 46 may have one end (not shown) permanently attached to the posting board so that the thong will not be lost or misplaced. A further arrangement for releasably retaining the record sheet 16 in assembly with the posting board 14 is shown in FIGS. 11 and 12. An elongated strip of magnetic material indicated at 48 is magnetically attached to the loops of the binding 20 in overlying relation with the loops, substantially as shown. The magnetic strip 48 has a group of holes 50 (one shown) punched in it so that it may be connected to and stored within the ring binder 12 when not in use.

The arrangement of the various fold lines in bisecting relation to the columns of holding slots 34, 34 enable the posting board to be folded to closed position with one or more record sheets attached to it. Further, this arrangement of fold lines enables the record sheet to be folded quite easily, since there is less paper in the region of the fold lines to resist folding. Thus, tendency is lessened for the fold to occur in an incorrect position when the posting board is folded to closed position. In the closed position the record sheet or forms on the posting board are attached to it by only one column of retaining slots 34, 34 which receive associated sets of loops therethrough. The remaining columns of retaining slots disposed along the folded edges of the record sheet or sheets take the form of open slots which engage and only partially surround respectively associated wire loop bindings. This arrangement substantially eliminates any tendency for the record sheets to become jammed on the retaining posts when several record sheets are stored within the closed posting board; a problem often encountered in posting board apparatus of this type. The movable arrangement of the various wire loop bindings with respect to the panels of the posting board compensate for inaccuracies in punching the record sheets and forms and further compensate for variations in dimensions of the sheets and forms. Further, this loose arrangement of the wire loop bindings enables the forms and record sheets to be easily positioned on and removed from the various holding pegs, collectively defined by the sets of binding loops 28, 28. The inherent flexibility of the loop bindings further contribute to the ease of positioning record sheets on and removing them from the posting board.

The arrangement of the various panels and binders enable a record sheet to be retained on the posting board and ring binder in all positions necessary to enable full utilization of all of the available posting space on the record sheet.

When a closed posting board is stored in a file drawer with forms attached thereto, in the manner of the forms 17, 17 shown in FIG. 1, the forms depend from the wire loop binding which retains them and have less tendency to warp or deform during prolonged storage, so that accurate registry between the forms and record sheet is assured when the posting apparatus is used.

While the invention has been illustrated and described with reference to a three panel foldable posting board, it should be understood that various forms of posting board assemblies are contemplated within the scope of the invention. A posting board assembly in accordance with the invention, may, for example, comprise a single flat panel of rigid or semi-rigid material with a first series of holes along one marginal edge which receive the loops of a wire binding. The assembly further includes a plurality of forms which may, for example, comprise a record sheet with apertures along one edge through which posts defined by the wire loops may be inserted, and a ledger card or fanned stack of forms, such as conventional one-write carbon stripped checks with similar apertures along one marginal edge. The apertures in the forms cooperate with the posts or pegs defined by the loops to hold the forms in alignment so that an entry written on the top form will, by transfer means, such as carbon or carbonless coating, be transferred to the proper position on an underlying form or forms.

A multiple rail flat posting board may be similarly constructed by providing a panel, such as aforedescribed, with a second wire loop binding attached along another marginal edge of the panel in the aforedescribed manner. Because the diameter of the holes along the edges of the rigid or semi-rigid panel is larger than the diameter of the wire used to form the two series of loops, the loops of each series are free to move in unison a small restricted distance relative to the loops of the other series to accommodate minor differences in the spacing between two or more series of apertures in the record sheet so that the sheet lies flat on the panel.

In accordance with the illustrated embodiment of the invention a multiple rail folding posting board assembly comprises two or more panels connected by a common set of wire loops which serve both to hold the panels in hinged relationship and to provide a pegrail for engaging apertures in various forms. One or more of the free outer edges of these panels may be fitted with another set of wire loops which may or may not hingedly connect the panel to still another panel or leaf. A three-rail folding posting board may, for example, comprise two panels hingedly connected by a common wire binding defining a set of wire loops. Two other bindings defining two other sets of wire loops are respectively connected to the outer or free marginal edge portions of the two panels. The loops are, of course, slightly movable relative to the panels to accommodate minor variations in the punching of a single record sheet which may be arranged in three different positions on the posting board. The wire loops along the left free edge of the posting board may be engaged in apertures in a journal sheet and may also hold a fanned stack of one-write style checks in registration with the cash disbursement section of the underlying journal sheet. The center set of loops, which define the hinge engage apertures in the journal sheet and may also hold a vendor ledger card, for example, so that the check, journal sheet, and ledger card are maintained in proper alignment for simultaneous posting. The third set of wire loops extend along the free right-hand edge of the posting board, may engage a third row of apertures in the journal sheet, and also engage a mating set of apertures in a general ledger card so that these items may also be held in alignment for simultaneous posting. A long journal or record sheet printed fully on both sides and having two vertical fold lines running through the center of the columns of apertures corresponding to the center and right columns of the wire loops of the posting board may be used to form a six panel sheet which may, for example, have a payroll section on its third panel, that is the right-hand end panel of the journal sheet. This third panel may be folded back under the stack of checks to facilitate payroll posting in the manner discussed in my previously mentioned U.S. patents. However, the present construction provides an advantage in that the open slots created by folding the journal sheet at the apertures will engage associated post defining loops on the posting board to hold it firmly in proper alignment with the folded payroll section of the journal and with a payroll stub along the top edge of an associated check.

Because the wire loops are somewhat flexible it is easier to place a ledger card or other form or set of forms over them and to remove same than is the case when solid pegs are utilized.

The folding posting board described herein may have roughly the dimensions of a file folder, and the leaves of the folding posting board may be of slightly different width so that when closed the wire loops at the free outer edges do not fold against each other to enable the posting board to be closed quite flat. A third panel or leaf of greater width than the other two leaves may be bound onto the center row of loops which form the hinge. When the folding posting board is closed it may be dropped into a file drawer and this third higher leaf will project above the other two leaves and above both rows of wire loops where it may serve as an index guide to identify the contents of the folder. This wider leaf may also be punched with holes to go over the rings of a standard ring binder which may also serve to store completed journal sheets, and blank sheets for future use. When the ring binder is opened and the folding posting board is folded out to the open position, posting may be done without removing it from the ring binder. In this instance all six panels of the two-fold sheet hereinbefore described become usable, because the reverse side of panel one of the completed sheet, which has been turned over the rings to the left, is now upwardly facing and may be used for columnar or other distribution. The ring binder may also contain pockets to house limited numbers of ledger cards used with the system. Two or more folding posting boards may be retained and used in a single ring binder. For instance, one posting board may be used for check disbursements and payroll, and a second for sales and cash receipts so that the complete set of records for one small company may be kept and used in one compact standard ring binder which may be filed in a file drawer or placed in a standard brief case.

Master offset heading sheets of the type described in my U.S. Pat. No. 3,498,640 may be used to eliminate the need to rewrite column headings on every page or column headings may be written directly along the top of the leaves of the posting board.

I claim:

1. A foldable posting board assembly comprising a foldable posting board and at least one record sheet, said foldable posting board having at least two generally rectangular panels and means for hingedly connecting said panels together in foldable relation to each other about a hinge line and defining a column of mounting elements located along a line substantially coincident with said hinge line to hold a portion of said one record sheet in a predetermined position relative to said posting board, said posting board being movable between an opened position wherein said panels are disposed within a generally common plane and a closed position wherein said panels are in generally overlying relation relative to each other, said mounting elements projecting beyond a surface of said panels when said posting board is in its opened position, said one record sheet having a column of apertures therethrough spaced inwardly from the edges thereof and a fold line extending thereacross in generally bisecting relation to said apertures and dividing said record sheet into separate sections, said mounting elements projecting bodily through said apertures and beyond said one record sheet when said posting board is in its open position and said one record sheet is unfolded along said fold line, said apertures when said record sheet is unfolded along said fold line serving to each entirely surround a respective one of said mounting elements to locate said record sheet relative to said mounting elements, said one record sheet being foldable along said fold line with said mounting elements projecting therethrough and to a position wherein one of said sections overlies another of said sections, and said apertures when said record sheet is folded along said fold line serving to each partially surround a respective one of said mounting elements to locate said record sheet relative to said mounting elements.

2. A foldable posting board as set forth in claim 1 wherein said means for hingedly connecting said panels and defining said mounting elements comprises ring shaped members connecting said panels through openings formed in said panels.

3. A foldable posting board as set forth in claim 2 wherein said means for hingedly connecting said panels comprises a binding formed from a length of resilient wire and having a column of loops defining binding rings for hingedly connecting said panels and said mounting elements.

4. A foldable posting board assembly as set forth in claim 3 wherein said posting board includes means for holding another portion of said record sheet in a predetermined posting position relative to said posting board and including another binding formed from another length of resilient wire and having another column of loops connected to at least one of said panels through openings in said one panel, said other column of loops projecting beyond the surface of said one panel and defining another column of mounting elements, said one record sheet having another column of apertures therethrough and another fold line extending thereacross in generally bisecting relation to said apertures of said other column of apertures and separating another section of said one record sheet from an adjacent section thereof, said apertures of said other column of apertures when said record sheet is unfolded along said fold line serving to each entirely surround a respective one of said mounting elements of said other column mounting elements to locate said record sheet relative to said mounting elements of said other column of mounting elements and said apertures of said other column of apertures when said record sheet is folded along said fold line serving to each partially surround a respective one of said mounting elements of said other column of mounting element to locate said record sheet relative to said mounting elements of said other column of mounting elements.

5. A foldable posting board as set forth in claim 2 wherein said posting board assembly includes another panel and said other binding comprises means for hingedly connecting said one panel to said other panel.

6. A foldable posting board as set forth in any one of claims 3 through 5 wherein said loops comprises sets of loops and each of said sets includes at least two loops.

7. A foldable posting board as set forth in any one of claims 3 through 5 wherein said loops are disposed in parallel planes generally normal to said panels.

8. A foldable posting board as set forth in claim 7 wherein said loops are interrupted generally circular loops.

9. A foldable posting board as set forth in claim 5 wherein said other panel comprises a third panel.

10. A foldable posting board assembly as set forth in any one of claims 1 or 3 including retaining means for releasably securing said one record sheet to said mounting elements.

11. A foldable posting board as set forth in claim 10 wherein retaining means comprises a plurality of tabs on said record sheet, each of said tabs being disposed within an associated one of said loops.

12. A foldable posting board as set forth in claim 11 wherein each of said apertures is partially defined by at least one of said tabs.

13. A foldable posting board as set forth in claim 11 wherein each of said apertures is partially defined by two of said tabs.

14. A foldable posting board as set forth in claim 13 wherein said two tabs are opposing tabs.

15. A foldable posting board as set forth in claim 14 wherein each of said aperture comprises a generally bone shaped slot.

16. A foldable posting board as set forth in claim 10 wherein said retaining means comprises an elongated member extending through said mounting elements.

17. A foldable posting board assembly as set forth in claim 10 wherein said retaining means comprises an elongated member magnetically attached to said mounting elements.

18. A foldable posting board as set forth in claim 1 wherein said panels differ in horizontal width.

19. A foldable posting board as set forth in claim 18 wherein one of the panels has a side marginal portion defining a heading space and disposed outwardly beyond associated side edges of the other of the panels when the posting board is folded to its closed position.

20. A foldable posting board assembly comprising a foldable posting board and at least one record sheet, said foldable posting board having at least two generally rectangular panels, each of said panels having a vertical column of openings therethrough extending along at least one side marginal portion thereof, a first binding formed from a length of resilient wire and having a vertical column of loops, each of said loops extending through an associated one of the openings in each of said panels, said first binding hingedly connecting said panels together in foldable relation to each other for movement between open and closed positions, said panels in said open position being located on opposite sides of said binding, said loops defining a first column of posts projecting beyond the surfaces of said panels when said panels are in said open position, said one record sheet having a vertical column of apertures therethrough, each of said posts extending through an associated one of said apertures, said posts and said apertures cooperating to retain said one record sheet in assembled relation with said posting board and in predetermined posting position relative to said panels, and retaining means for releasably securing said one record sheet to said posts and including an elongated member inserted through said loops.

21. A foldable posting board as set forth in claim 20 wherein said elongated member comprises a rigid rod.

22. A foldable posting board as set forth in claim 20 wherein said elongated member comprises a flexible thong.

23. A posting board assembly comprising a posting board including at least one rectangular panel having a series of openings therethrough, at least one record sheet having a column of apertures therethrough and a fold line extending thereacross and generally bisecting said apertures, and means defining a column of mounting elements connected to said panel and projecting above the surface thereof for receiving said record sheet thereon with each of said mounting elements projecting bodily through an associated one of said apertures and holding said record sheet in a posting position relative to said one panel and including a length of resilient wire having a series of loops connected to said panel through said openings, said loops defining said mounting elements and being movable relative to said panel in directions within the plane of said panel, said one record sheet being foldable about said fold line and relative to said pegs and into overlying relation to an adjacent section thereof to a posting position relative to said adjacent section.

24. A posting board assembly as set forth in claim 23 wherein each of said mounting elements is defined by a plurality of said loops.

25. A posting board as set forth in claim 23 including means for releasably securing said one record to said mounting elements and comprising an elongated member extending through said loops.

26. A foldable posting board assembly comprising a loose leaf ring binder having a plurality of retaining rings, a foldable posting board, and at least one record sheet, said foldable posting board having a plurality of generally rectangular panels including at least two panels of differing horizontal width, the wider one of said two panels having holes along one vertical marginal portion thereof receiving said retaining rings therethrough, said foldable posting board having means for hingedly connecting the other vertically extending marginal portion of said one panel to an associated vertically extending marginal portion of the other of said two panels to fold about a hinge line to a closed position wherein said other panel is disposed in generally overlying relation to said one panel and defining a column of mounting elements located along a line substantially coincident with said hinge line for holding one portion of said record sheet in a predetermined posting position relative to said panels when said panels are in an open position wherein said panels are disposed in a generally common plane, said hingedly connecting and holding means including a binding formed from a length of resilient wire having a vertical column of loops defining binding rings connecting said one panel in hinged relation to said other panel through openings formed in adjacent marginal portions of said one and said other panel, said loops defining said mounting elements and projecting beyond the surfaces of said panels when said posting board is in its open position, said record sheet having a vertical column of apertures and a fold line extending vertically thereacross in bisecting relation to said apertures and dividing said record sheet into separate sections, each of said mounting elements extending bodily through and associated one of said apertures when said record sheet is unfolded along said fold line, said apertures when said record sheet is unfolded along said fold line serving to each entirely surround a respective one of said mounting elements to locate said record sheet relative to said mounting elements and said apertures when said record sheet is folded along said fold line serving to each partially surround a respective one of said mounting elements to locate said record sheet relative to said mounting elements.

27. A foldable posting board assembly comprising a foldable posting board, at least one record sheet, said foldable posting board having at least two generally rectangular panels, each of said panels having a vertical column of openings therethrough extending along at least one side marginal portion thereof, and a first binding formed from a length of resilient wire and having a vertical column of loops, each of said loops extending through an associated one of the openings in each of said panels, said first binding hingedly connecting said panels together in foldable relation to each other for movement between open and closed positions, said panels in said open position being located on opposite sides of said binding, said loops defining a first column of posts projecting beyond the surfaces of said panels when said panels are in said open position, said one record sheet having a vertical column of apertures therethrough, each of said posts extending through an associated one of said apertures, said posts and said apertures cooperating to retain said one record sheet in assembled relation with said posting board and in predetermined posting position relative to said panels, and retaining means for releasably securing said one record sheet to said posts and including an elongated member magnetically attached to said loops.

* * * * *